United States Patent [19]

Stahlecker et al.

[11] Patent Number: 4,676,673

[45] Date of Patent: Jun. 30, 1987

[54] BEARING DISK CONSTRUCTION FOR SUPPORTING A SPINNING ROTOR SHAFT OF AN OPEN-END SPINNING MACHINE

[75] Inventors: Fritz Stahlecker, Josef-Neidhart-Strasse 18, 7347 Bad Überkingen; Werner Zott, Donzdorf, both of Fed. Rep. of Germany

[73] Assignees: Fritz Stahlecker; Hans Stahlecker, both of Fed. Rep. of Germany

[21] Appl. No.: 689,075

[22] Filed: Jan. 4, 1985

Related U.S. Application Data

[63] Continuation-in-part of Ser. No. 627,559, Jul. 3, 1984.

[30] Foreign Application Priority Data

Jul. 5, 1983 [DE] Fed. Rep. of Germany ..... 3324129
Nov. 16, 1984 [DE] Fed. Rep. of Germany ... 8433579[U]

[51] Int. Cl.[4] ..... F10C 13/00; D01H 1/24
[52] U.S. Cl. ..... 384/549; 57/103
[58] Field of Search ..... 384/549, 550, 548, 569, 384/277, 278, 297, 418, 900; 474/93, 188–191; 57/103, 104, 105, 404, 406, 92

[56] References Cited

U.S. PATENT DOCUMENTS

| | | | |
|---|---|---|---|
| 306,538 | 10/1884 | Shepherd | 474/188 X |
| 2,039,560 | 5/1953 | Cosmos | 474/188 |
| 3,313,096 | 4/1967 | Marciniak | 57/103 X |
| 3,613,467 | 10/1971 | Lee | 57/346 X |
| 3,779,620 | 12/1973 | Stahlecker | 384/549 |
| 3,793,820 | 2/1974 | Rajnoha | 57/103 X |
| 3,805,506 | 4/1974 | Stahlecker | 57/406 X |
| 3,901,011 | 8/1975 | Schuster | 57/339 |
| 3,964,324 | 6/1976 | Gassner et al. | 57/103 X |
| 4,020,710 | 5/1977 | Gassner et al. | 57/103 X |

FOREIGN PATENT DOCUMENTS

| | | | |
|---|---|---|---|
| 1901453 | 8/1970 | Fed. Rep. of Germany . | |
| 2112913 | 10/1972 | Fed. Rep. of Germany . | |
| 2206264 | 8/1973 | Fed. Rep. of Germany | 57/103 |
| 2206237 | 8/1973 | Fed. Rep. of Germany . | |
| 2311975 | 9/1974 | Fed. Rep. of Germany . | |
| 2801693 | 7/1979 | Fed. Rep. of Germany . | |
| 3342768 | 6/1985 | Fed. Rep. of Germany . | |

*Primary Examiner*—Stuart S. Levy
*Assistant Examiner*—Thomas R. Hannon
*Attorney, Agent, or Firm*—Barnes & Thornburg

[57] ABSTRACT

A bearing disk construction is disclosed for an open end spinning rotor at a spinning unit of the type having a rotor mounted on a rotor shaft, a twin disk bearing arrangement for rotatably supporting the rotor shaft and a tangential belt drivingly engaging the rotor shaft of the radial side thereof opposite the twin disk arrangement. The bearing disks are formed with a metallic base body and a plastic fitting around the circumference thereof which directly supportingly engages the rotor shaft. To minimize heating of the system during high speed operation, the plastic fittings are provided with a circumferential ring groove which is geometrically configured to optimize bearing support and heat dissipation. The plastic fitting is anchored in a groove at the circumference of the base body by moulding the plastic at the base body.

28 Claims, 4 Drawing Figures

BEARING DISK CONSTRUCTION FOR SUPPORTING A SPINNING ROTOR SHAFT OF AN OPEN-END SPINNING MACHINE

This application is a continuation in part of co-pending commonly assigned U.S. patent application Ser. No. 627,559, filed July 3, 1984, which relates to a Bearing And Driving Arrangement For A Spinning Rotor Of An Open-End Spinning Machine.

BACKGROUND AND SUMMARY OF THE INVENTION

The invention relates to a bearing disk construction for supporting a spinning rotor shaft of an open-end spinning unit of the type disclosed in said co-pending application. To the extent necessary for an understanding of the present invention, the contents of this pending application are incorporated herein by reference thereto. U.S. Pat. No. 3,779,620 also relates to a bearing assembly of the type with which the bearing disk constructions of the present invention could be utilized.

The above-mentioned pending application and U.S. Pat. No. 3,779,620 suggest the use of two pairs of supporting disks forming a wedge-shaped gap for supporting from underneath the spinning rotor shaft, the rotor shaft being held and pushed against the supporting disks by a driving belt. In the above noted co-pending application, these supporting disks are formed with a metallic disk-shaped base body having a plastic ring fitting circumferentially surrounding same for engaging the spinning rotor shaft. This co-pending application suggests providing that the running surfaces of at least the supporting disks of the pair facing or closest to the rotor be arranged with a circumferential ring groove in order to avoid that the running or bearing surfaces are heated with an increased rotational speed in an inadmissible manner.

The present invention is particularly concerned with providing an improved practical construction of the bearing arrangements, and especially the supporting disks themselves for use in bearing arrangements of the above-mentioned type. Preferred embodiments of the supporting disk construction in accordance with the present invention are constructed with a metallic disk-shaped base body surrounded by a plastic fitting ring, the plastic ring forming the bearing support or running surfaces for the rotor shaft. According to an especially advantageous feature of the present invention, the plastic fitting ring is anchored in a circumferential groove provided in the metallic base body. This arrangement facilitates the ease of manufacture and assures a reliable retention of the plastic fitting ring at the metallic base body.

According to certain preferred embodiments of the invention, the plastic fitting ring includes a circumferential outer ring groove of a specific configuration for minimizing heat build up during use of the bearing disk. In order to minimize the heat build up while at the same time providing for a good running surface for the rotor shaft, it has been determined according to the invention that the following geometric relationships between the plastic fitting ring and groove are advantageous:

(i) the width of the groove in the axial direction of the disk is between one-sixth (1/6) and one-twelfth (1/12) of the total axial width of the plastic fitting ring;

(ii) the radial depth of the groove is approximately one-half of the total radial thickness of the fitting ring; and (iii) the groove is disposed in the axial middle of the fitting ring.

In especially preferred embodiments, the plastic fitting ring has chamfered or bevelled edges at the inlet to the ring groove at both sides, which bevelled edges extend at an angle slightly less than 45° with respect to the radius of the disk and to a depth of about one-third ($\frac{1}{3}$) the radial depth of the groove. Bevelled edges are also preferably provided at the axial end faces of the fitting ring. This bevelled edge construction minimizes stress areas and accommodates a smooth running relationship between the fitting ring and the rotor shaft supported thereon. In especially preferred embodiments, these bevelled edges and the rotor shaft support surfaces of the plastic fitting ring are smoothly polished.

According to especially preferred embodiments of the invention, the plastic fitting ring is formed of the material Simritan x 95 AU 19 785, a polyurethane, manufactured by the firm Freudenberg in Germany, which material exhibits a hardness of 52 Shore D.

In especially advantageous arrangements of the supporting disk, the metallic base body includes an annular cut-out between a hub portion for accommodating the support axle for the disk and a rim portion for supporting the plastic fitting ring. This construction further minimizes the weight and energy dissipating resistive moment of the bearing arrangement, while retaining the necessary support for the axle and for the plastic fitting ring which engages the rotor support shaft.

Preferred embodiments of the invention contemplate that at least the pair of support disks closest to the rotor are provided with the heat minimizing ring groove at the plastic ring fitting. However, especially preferred embodiments of the invention contemplate the provision of such ring grooves in all four of the supporting disks.

The construction of the disks according to the present invention is especially advantageous for use with modern high rotational speed rotor spinning machinery where rotor speeds in excess of 80,000 revolutions per minute (rpm) are contemplated. Not only does the arrangement of the combination metallic disk body and plastic ring fitting minimize the weight and energy requirements of the supporting disks while retaining the structural integrity to withstand the high forces exerted by the driving of the rotors during use, the disk construction of the invention optimizes the minimization of heat build up during use and facilitates an economical and reliable manufacture of the disk.

Further objects, features, and advantages of the present invention will become more apparent from the following description when taken with the accompanying drawings(s) which show, for purposes of illustration only, an embodiment/several embodiments in accordance with the present invention.

DETAILED DESCRIPTION OF THE DRAWINGS

Figure 1:
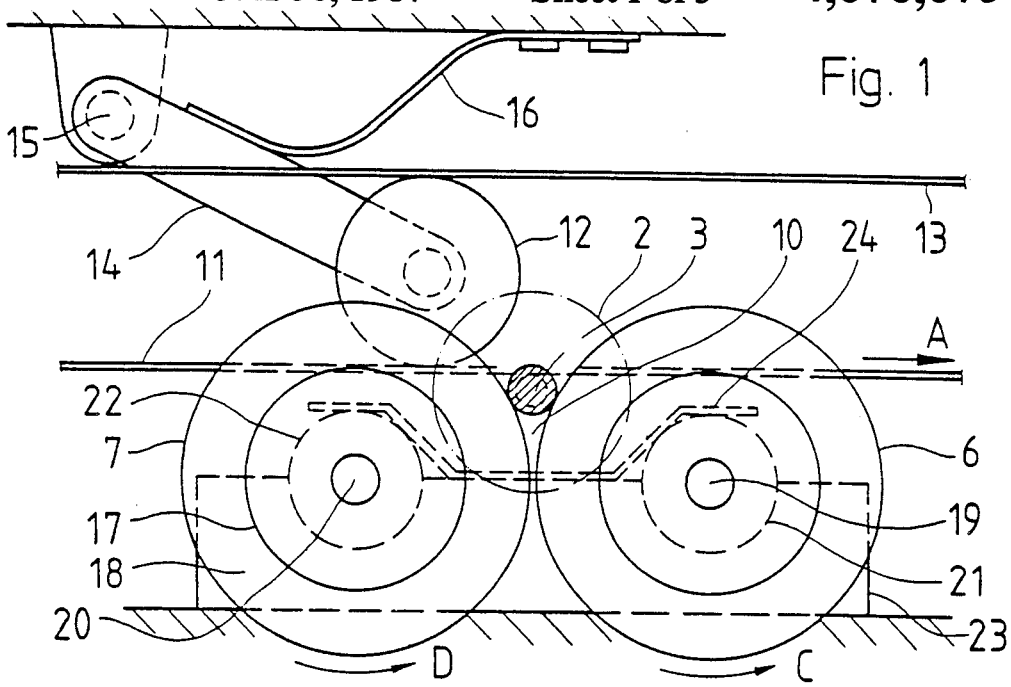
FIG. 1 is a front schematic view through a spinning rotor bearing and driving arrangement constructed in accordance with a preferred embodiment of the present invention, with a cross-sectional showing of the shaft of a spinning rotor indicated by dotted lines.

In the drawings and the following description, like reference characters are used throughout the various views to designate like structures.

In order not to obscure the present invention, the drawings and the following descriptions only include those parts of a rotor spinning machine as are deemed necessary for one skilled in the art to practice the invention. For example, it will be understood by one skilled in the art of rotor spinning that a complete rotor spinning machine would include a plurality of spinning units arranged adjacent one another and each having a spinning rotor and bearing assembly with certain common driving elements such as the tangential belt described below. However, the invention could also be utilized with machines having separate driving motors or the like for each spinning unit.

The spinning rotor 1 of the illustrated embodiment includes a rotor 2 supported on a rotor shaft 3. The rotor 2, which is pressed upon shaft 3 by means of a ring band, exhibits a hollow space known in the art for accommodating spinning of fibers into yarn and which space proximately corresponds to the outer contour of the rotor, whereby the greatest inner diameter is formed by a fiber collecting groove connecting with a fiber slide wall.

The shaft 3 of the spinning rotor 1 is disposed in the wedge gap formed by two pairs of supporting disks 4 and 5, which each includes two supporting disks 6, 7 and 8, 9. The supporting disks 6, 7, 8 and 9 include respectively a metallic disk-shaped base body 17 having a fitting 18, i.e., a plastic ring, the circumferential surface of which ring forms the respective running surface for shaft 3. The base body 17 of the supporting disks 6, 8 and 7, 9 which respectively are arranged at one side of shaft 3, include axles 19 and 20 which are borne in bearing housings 21 and 22 by means of roller bearings. The bearing housings 21 and 22 are inserted into a common bearing seat or block 23 in shell-like receptacles in which they are secured by means of holders 24 formed as spring clamps.

Axles 19 and 20 of the supporting disks 6, 8 and 7, 9 extend in planes parallel to each other. They are set against each other in an angle having a size about one degree in vertical direction to this plane, whereby the cross axle is approximately centered between the supporting disks 6, 8 and 7, 9. The offset angle is worked into the shell-like receptacles of the bearing block 23.

The rotor shaft 3 is driven directly by a run 11 of a tangential belt which secures the shaft 3 within the wedge gap of the pairs of supporting disks 4 and 5. The run 11 of the tangential belt is loaded with supporting roller 12 which is arranged in operational direction A of the run 11 closely in front of the shaft 3 (FIG. 1). The return run 13 of the tangential belt is guidable at the top of pressure roller 12. The pressure roller 12 is pivotably supported upon a swivel arm 14 for movement about an axle 15 and is freely rotatable, the arm 14 being resiliently forced in the direction toward the belt run 11 by means of a spring 16.

Via the offsetting of axles 19 and 20 in connection with the operational direction A of run 11 of the tangential belt, and the rotational directions C and D of the supporting disks, a transverse force in the direction of Arrow B is applied upon shaft 3 of the spinning rotor 1. Said transverse force is directed via the rotor shaft to a step bearing roller 27 which is supported against this transverse force by means of a spring-like bolt 28.

Figure 2:
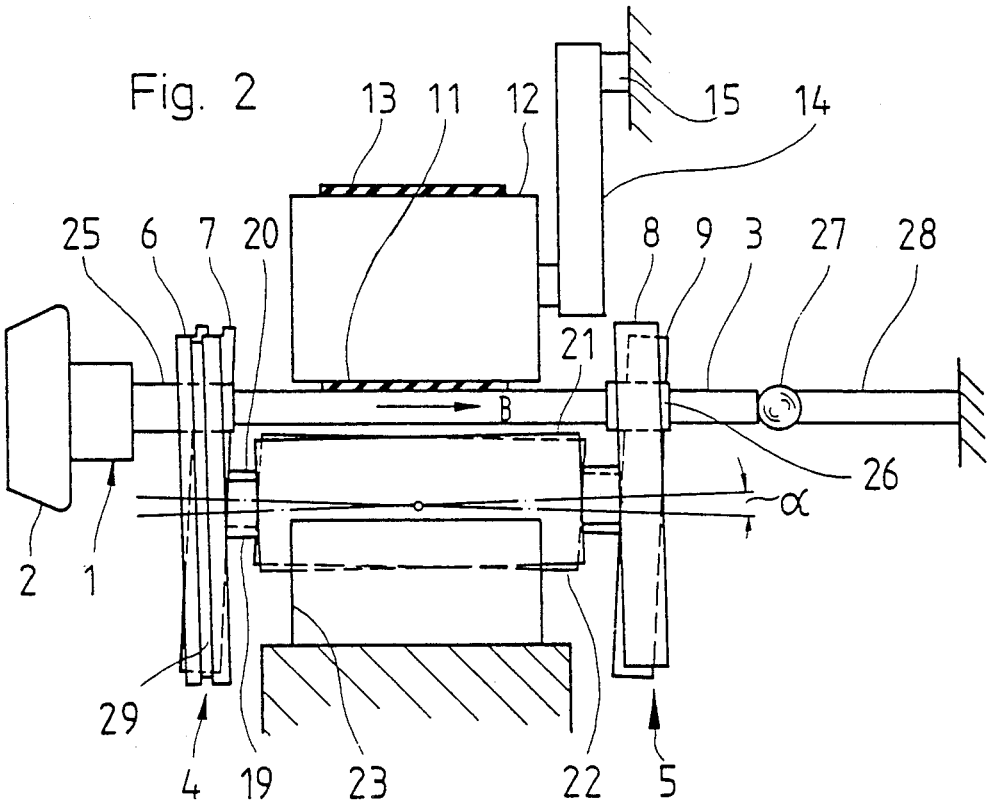
FIG. 2 is a side schematic view of the spinning rotor bearing and driving arrangement according to FIG. 1.
Figure 3:
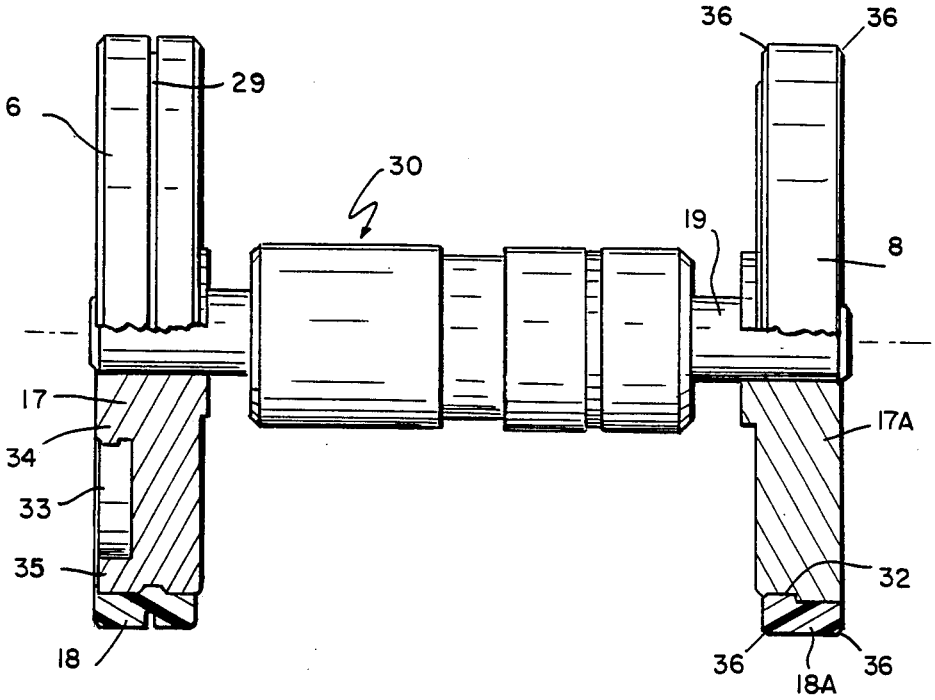
FIG. 3 is a side, part sectional schematic view depicting a pair of support disks at a bearing assembly, constructed in accordance with a preferred embodiment of the present invention.

Referring to FIG. 3, the supporting disks 6 and 8 are shown supported on a bearing assembly 30 with disk support axle 19. The bearing assembly 30 would be supported in use in the shell-like receptacles of the bearing block 23 described in conjunction with FIGS. 1 and 2 above. The supporting disks 6 and 8 each include a metallic base body 17, 17A, to which the axle 19 is attached. The plastic fitting ring 18 of supporting disk 6 is anchored at the base body 17 via an anchoring groove 31. In a corresponding manner, the plastic fitting ring 18a of disk 8 is supported via an anchoring groove 32 of the base body 17A.

The base body 17 of support disk 6 includes an annular cut-out recess 33 which separates a hub portion 34 for accommodating the axle 19 and a rim portion 35 for accommodating support of the plastic fitting ring 18. The fitting ring 18 includes an outer circumferential ring groove 29, described in more detail with respect to FIG. 4 below.

The support disk 8 (right side of FIG. 3) includes a fitting ring 18A which has a smooth outer circumference for engaging against the rotor support shaft. The edges 36 of the fitting ring 18A are bevelled or chamfered at an angle of approximately 45° to facilitate reduction of stresses at the corners and accommodate a smooth running surface for the rotor shaft being supported.

Figure 4:
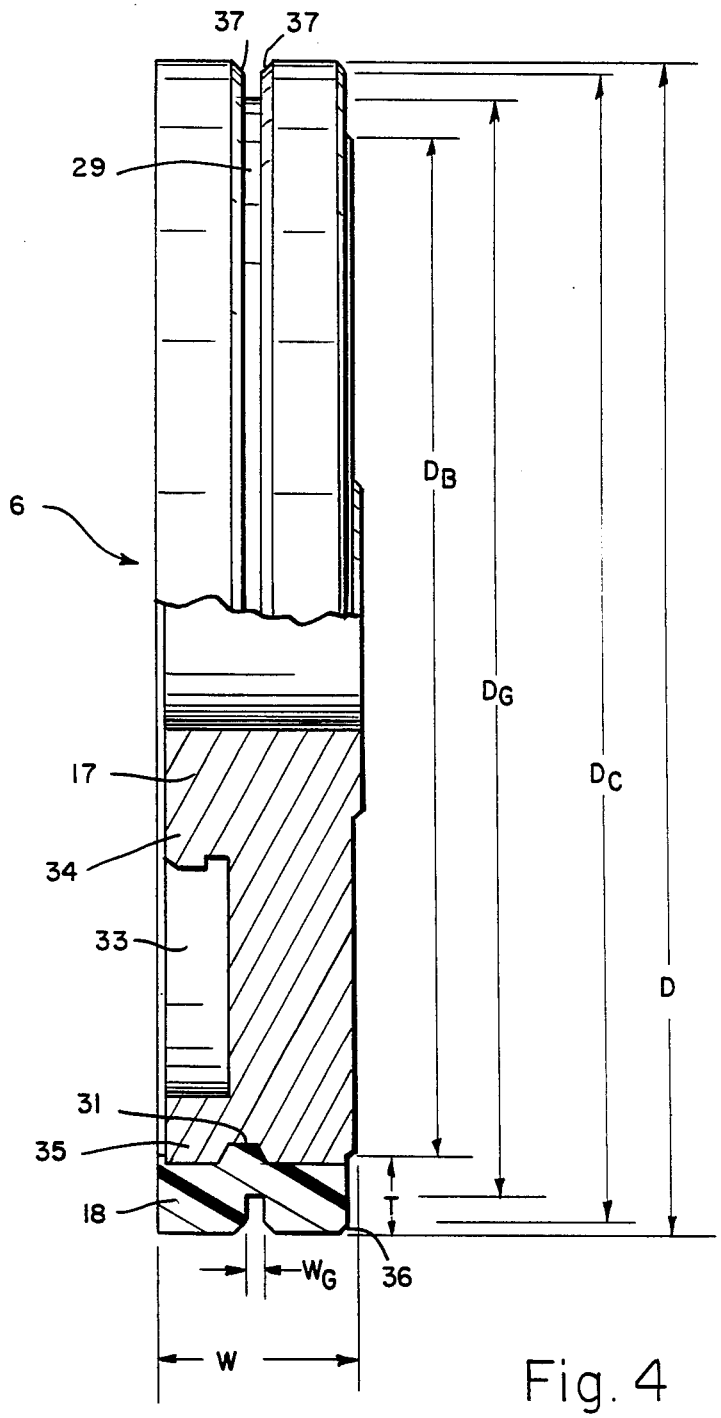
FIG. 4 is an enlarged side, part sectional schematic view showing details of the construction of a support disk according to a preferred embodiment of the present invention.

Referring to FIG. 4, the support disk 6 is shown in enlarged form to depict the construction of details of the fitting ring 18. The overall outside diameter of the disk 6 is depicted by "D", the diameter at the bottom of the ring groove 29 is depicted by $D_G$, the diameter of the metallic base body 17 is depicted by $D_B$ and the diameter at the inside of the chamfered sections 37 leading into the ring groove are depicted by $D_C$. The overall axial width of the disk 6 is depicted by W, and the axial width of the ring groove 29 is depicted by $W_G$. The plastic fitting ring 18 has a radial thickness $T=(D-i\ D_B)/2$ of between one-fifth and one-tenth of the radius D/2. In especially preferred embodiments, this thickness T is about 5 mm with the total diameter D being about 70 mm. The axial width $W_G$ of the ring groove 29 is preferably in the range of one-sixth to one-twelfth of the overall axial width W of the plastic fitting 18. In especially preferred embodiments, the width $W_G$ is less than one-tenth of the width W. Chamfered or bevelled sections 37 leading into the ring groove 29 are disposed at an angle of 45° to the radius of the disk and extend radially inwardly to a depth of about one-third the depth of the groove 29.

In especially preferred embodiments, the base body 17 is formed of an aluminum alloy and the ring fitting 18 is formed of a plastic having a Shore D hardness of 52, a product by the name of Simritan x 95 AU 19 785, supplied by the firm Freudenberg of Germany, is used as the plastic fitting material.

For purposes of illustration, the ring groove arrangement for minimizing heat is only shown in the disks closest to the rotor. In other especially preferred practical embodiments, such a ring groove construction is provided for all four disks. Such preferred embodiments would utilize a disk conforming to the FIG. 4 illustration of disk 6 for all four disks.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Disk for a bearing assembly for spinning rotors of the type having four disks arranged in two pairs forming a wedge-shaped gap for supporting a shaft of said spinning rotor at outer rotor shaft support surfaces of the disk, said disk having a circumferential surface and an axial width, wherein the circumferential surface of said disk is provided with a ring groove for minimizing heat build up during use, said ring groove having an axial width, a radial depth, and side walls, and wherein the radial depth of the ring groove is greater than its axial width, wherein the axial width of the ring groove is between one-sixth and one-twelfth of the axial width of the disk, and wherein bevelled sections connect the side walls of the ring groove and the outer rotor shaft support surfaces of the disk.

2. Disk according to claim 1, wherein the bevelled sections extend to a depth of about one-third the depth of the ring groove.

3. Disk according to claim 1, said disk having a radius, wherein the bevelled sections extend at an angle of approximately 45 degrees to the radius of the disk.

4. Disk according to claim 1, said disk having axial end faces including an outer radial portion, wherein the outer radial portion of the axial end faces of the disk are provided with bevelled sections.

5. Disk according to claim 4, wherein the bevelled sections and the rotor shaft support surfaces of the disk are polished.

6. Disk for a bearing assembly for spinning rotors of the type having four disks arranged in two pairs forming a wedge-shaped gap for supporting a shaft of said spinning rotor at outer rotor shaft support surfaces of the disk, said disk having a circumferential surface and an axial width, wherein the circumferential surface of said disk is provided with a ring groove for minimizing heat build up during use, said ring groove having an axial width, a radial depth, and side walls, and wherein the radial depth of the ring groove is greater than its axial width, wherein the axial width of the ring groove is between one-sixth and one-twelfth of the axial width of the disk, wherein said disk has a metallic disk-shaped body having a circumference and a ring-shaped fitting made from plastic material disposed around the circumference of the disk-shaped body to be directly supportingly engageable with a spinning rotor shaft, and wherein bevelled sections connect the side walls of the ring groove and the outer rotor shaft support surfaces of the disk.

7. Disk according to claim 6, wherein the bevelled sections extend to a depth of about one-third the depth of the ring groove.

8. Disk according to claim 6, said disk having a radius, wherein the bevelled sections extend at an angle of approximately 45 degrees to the radius of the disk.

9. Disk according to claim 6, said ring-shaped fitting having axial end faces including an outer radial portion, wherein the outer radial portion of the axial end faces of the ring-shaped fitting are provided with bevelled sections.

10. Disk according to claim 9, wherein the bevelled sections and the rotor shaft support surfaces of the ring-shaped fitting are polished.

11. Plastic ring-shaped fitting having a circumferential surface and an axial width for disposing around a circumference of a metallic disk-shaped body of a disk for a bearing assembly for spinning rotors of the type having four disks arranged in two pairs forming a wedge-shaped gap for supporting a shaft of the spinning rotor at outer rotor shaft support surfaces of the ring-shaped fitting, wherein the circumferential surface of said ring-shaped fitting is provided with a ring groove for minimum heat build up during use, said ring groove having an axial width, a radial depth, and side walls, wherein the axial width of the ring groove is between one-sixth and one-twelfth of the axial width of the ring-shaped fitting, and wherein the radial depth of the ring groove is greater than its axial width, and wherein bevelled sections connect the side walls of the ring groove and the outer rotor shaft support surfaces of the ring-shaped fitting.

12. A ring-shaped fitting according to claim 11, wherein the bevelled sections extend to a depth of about one-third the depth of the ring groove.

13. A ring-shaped fitting according to claim 11, said disk having a radius, wherein the bevelled sections extend at an angle of approximately 45 degrees to the radius of the disk.

14. A ring-shaped fitting according to claim 11, said ring-shaped fitting having axial end faces including an outer radial portion, wherein the outer radial portion of the axial end faces of the ring-shaped fitting are provided with bevelled sections.

15. A ring-shaped fitting according to claim 14, wherein the bevelled sections and the rotor shaft support surfaces of the ring-shaped fitting are polished.

16. Disk for a bearing assembly for spinning rotors of the type having four disks arranged in two pairs forming a wedge-shaped gap for supporting a shaft of the spinning rotor;

wherein said disk has a metallic disk-shaped body with a circumference and an axial center, and a ring-shaped fitting made from plastic material disposed around the circumference of the disk-shaped body to be directly supportingly engageable with the spinning rotor shaft during use, said ring-shaped fitting having a circumferential surface, an axial width with an axial center, and a radial thickness, wherein said metallic disk-shaped body exhibits an anchoring groove at the circumference thereof, wherein the ring-shaped fitting protrudes into and is anchored at the anchoring groove, wherein the circumferential surface of said ring-shaped fitting is provided with a ring groove for minimizing heat build up during use, said ring groove having an axial width and a radial depth, and wherein said anchoring groove is offset from the axial center of the metallic disk-shaped body.

17. A disk according to claim 16, wherein said ring groove exhibits an axial width which is between one-sixth and one-twelfth of the axial width of the ring-shaped fitting.

18. A disk according to claim 16, wherein the axial width of the ring groove is less than one-tenth of the axial width of the ring-shaped fitting.

19. A disk according to claim 16, wherein the radial depth of the ring groove is approximately one-half the radial thickness of the ring-shaped fitting.

20. A disk according to claim 16, wherein the radial depth of the ring groove is greater than its axial width.

21. A disk according to claim 20, wherein the axial width of the ring groove is between one-sixth and one-twelfth of the axial width of the ring-shaped fitting.

22. A disk according to claim 21, wherein the axial width of the ring groove is less than one-tenth of the axial width of the ring-shaped fitting.

23. A disk according to claim 22, wherein the radial depth of the ring groove is approximately one-half the radial thickness of the ring-shaped fitting.

24. A disk according to claim 16, wherein the ring groove is disposed in the axial center of the ring-shaped fitting.

25. A disk according to claim 24, wherein the radial depth of the ring groove is greater than its axial width.

26. A disk according to claim 25, wherein the axial width of the ring groove is between one-sixth and one-twelfth of the axial width of the ring shaped fitting.

27. A disk according to claim 26, wherein the axial width of the ring groove is less than one-tenth of the axial width of the ring-shaped fitting.

28. A disk according to claim 27, wherein the radial depth of the ring groove is approximately one-half the radial thickness of the ring-shaped fitting.

* * * * *